US006082046A

United States Patent [19]

Simmons

[11] Patent Number: 6,082,046

[45] Date of Patent: Jul. 4, 2000

[54] OVERHEAD DOOR SENSOR MOUNTING BRACKET

[76] Inventor: Kevin A. Simmons, 2906 Barnes Bridge, Dallas, Tex. 75228

[21] Appl. No.: 09/030,327

[22] Filed: Feb. 25, 1998

[51] Int. Cl.[7] ..... E05F 15/02

[52] U.S. Cl. ..... 49/26; 49/28

[58] Field of Search ..... 49/26, 27, 28, 49/197, 199, 200, 201; 160/1, 7, 8, 201

[56] References Cited

U.S. PATENT DOCUMENTS

| | | | |
|---|---|---|---|
| 2,271,309 | 1/1942 | Rowe | 49/199 |
| 3,247,893 | 4/1966 | Ford | 160/201 |
| 4,120,072 | 10/1978 | Hormann | 16/97 R |
| 4,922,168 | 5/1990 | Waggamon et al. . | |
| 4,953,608 | 9/1990 | Larsson | 160/201 |
| 5,233,185 | 8/1993 | Whitaker . | |
| 5,235,724 | 8/1993 | Perrin et al. | 160/201 |
| 5,371,970 | 12/1994 | Ganikon | 49/199 |
| 5,404,927 | 4/1995 | Bailey | 160/201 |
| 5,408,724 | 4/1995 | Mullet et al. | 16/94 R |
| 5,495,640 | 3/1996 | Mullet et al. | 160/201 |
| 5,508,511 | 4/1996 | Zur et al. | 49/26 |
| 5,533,561 | 7/1996 | Forehand, IV | 160/201 |
| 5,596,840 | 1/1997 | Teich . | |
| 5,720,332 | 2/1998 | Nachreiner | 160/201 |
| 5,743,046 | 4/1998 | Siegler et al. | 49/199 |
| 5,782,283 | 7/1998 | Kendall | 160/201 |
| 5,860,465 | 1/1999 | Eastridge et al. | 160/201 |

*Primary Examiner*—Daniel P. Stodola
*Assistant Examiner*—Curtis A. Cohen
*Attorney, Agent, or Firm*—David W. Quimby

[57] ABSTRACT

An overhead door safety sensor mounting bracket allows overhead door safety sensors to travel beneath the leading edge of an overhead door for substantially the full travel path of the overhead door as the overhead door closes. The mounting brackets attach to the bottommost roller axles of the overhead door on opposite lateral sides of the overhead door. As the overhead door approaches a closed position, the mounting brackets for the overhead door safety sensors rotate about the bottommost roller axles of the overhead door. The safety sensors are rotated up above the ground so that neither the safety sensors, nor the mounting brackets touch the ground.

7 Claims, 4 Drawing Sheets

OVERHEAD DOOR SENSOR MOUNTING BRACKET

BACKGROUND OF THE INVENTION (1) Field of the Invention

This invention relates in general to a mounting bracket, and more particularly to a mounting bracket for a sensor used to detect an object in the path of a closing overhead door.

(2) Description of Related Art

There are many types of mechanical door openers which are used to open and close overhead doors. In addition, there is legislation that requires all newly installed electronic garage door openers to have a safety device that will reverse the travel direction of a closing door if an obstruction is present within six inches of the door's closed position (ground level).

One type of prior art garage door safety device is a safety edge or compressible detector that is placed on the leading edge of the door. The advantage of this type of safety device is that the detector is located directly below the leading edge of the door. The detector travels with the door, and the detector senses objects in the path of the door throughout the entire travel path of the door. This type of safety device has the disadvantage that the door must physically contact an object before the door's downward motion is stopped.

U.S. Pat. No. 4,922,168, issued to Waggamon, et al., shows a safety system that uses a transmitter and a receiver which are laterally opposed near the edges of the door opening. The transmitter and the receiver mount a few inches away from the travel path of the door, and about four to six inches above the ground; and therefore, the transmitter and the receiver do not travel with the door as the door opens or closes. A beam is sent from the transmitter to the receiver. If the door is closing and an object is in the path of the beam, the beam will not be received by the receiver, and the door will stop and the travel direction of the door will be reversed.

An object can be positioned in the path of the closing door, yet not break the beam transmitted between the transmitter and the receiver. An example of this type of arrangement is a car that is parked so that the trunk of the car is in the path of the door while the beam passes unobstructed beneath the car. The beam between the transmitter and the receiver would pass under the car and not be interrupted, resulting in the closing door hitting the car.

U.S. Pat. No. 5,233,185, issued to Whitaker, and U.S. Pat. No. 5,596,840, issued to Teich, both show garage door safety systems which utilize sensors which travel with the garage door. The transmitting sensor and the receiving sensor are mounted adjacent to the door on support mechanisms which allow the sensors to vertically retract and extend. When the door is open, the sensors extend to a position adjacent to and below the leading edge of the door. As the sensors approach the ground, the lowest end of the support mechanism contacts the ground. As the door continues to close, the sensors vertically retract into the support mechanism until the door is fully closed. When the door opens, the sensors are again extended below and adjacent to the leading edge of the door.

To use these types of overhead door safety sensor mounts, an additional support mechanism must be attached to the overhead door. Obtaining proper positioning of the transmitter and receiver can be difficult, especially if the floor beneath the overhead door is not level. Additionally, the safety sensors are located adjacent to the leading edge of the door, not beneath the leading edge of the door.

SUMMARY OF THE INVENTION (1) Progressive Contribution to the Art

I have invented mounting brackets for mounting overhead door safety sensors that utilize a beam transmitted between a transmitter and a receiver to determine if an object is in the path of travel of the closing overhead door. The mounting brackets attach to the bottom roller axles of the overhead door. When the door is opened, the safety sensors are located directly below the leading edge of the door. As the door closes, the safety sensors travel below the leading edge of the door until the door is about six inches above the ground. At this position, the mounting brackets are rotated about the bottom roller axles of the overhead door, allowing the door to fully close while preventing the sensors from contacting the ground.

(2) Objects of this Invention

An object of this invention is to provide mounting brackets for overhead door safety sensors so that the safety sensors travel directly below the leading edge of the door for substantially the full path of door travel while the door is closing.

Another object is to provide mounting brackets for overhead door safety sensors which mount on existing overhead door structure members so that additional support structures for the safety sensors do not have to be mounted to the door.

Another object is to provide mounting brackets for overhead door safety sensors so that the safety sensors travel directly below the leading edge of the door for substantially the full path of door travel, and wherein the safety sensors and the mounting brackets do not contact the ground.

Further objects are to achieve the above with a device which is sturdy, compact, durable, light-weight, simple, safe, efficient, versatile, ecologically compatible, energy conserving and reliable; yet is inexpensive and easy to manufacture, install, maintain and use.

The specific nature of the invention, as well as other objects, uses, and advantages thereof, will clearly appear from the following description and from the accompanying drawings, the different views of which are not necessarily scale drawings.

Figure 1:
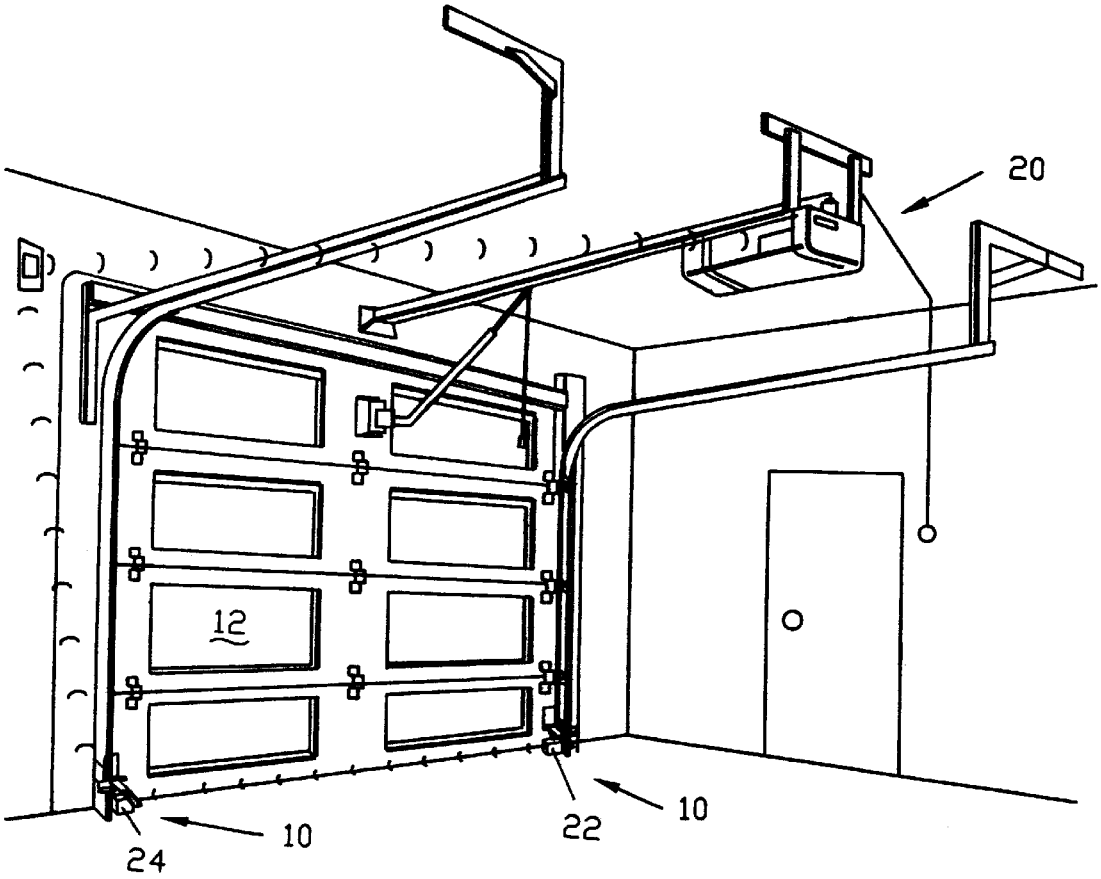
FIG. 1 is a perspective view of an overhead door opening system.

As an aid to correlating the terms of the claims to the exemplary drawings, the following catalogue of elements is provided:

10 mounting bracket
12 overhead door
14 roller
16 roller axle
18 door track
20 door opener assembly
22 transmitter
24 receiver
26 fixture
28 mounting surface
30 hinge mount

32 rotation arm
34 screws
36 stator
38 mount
40 arm
42 axle support

DESCRIPTION OF THE PREFERRED EMBODIMENTS

Figure 2:
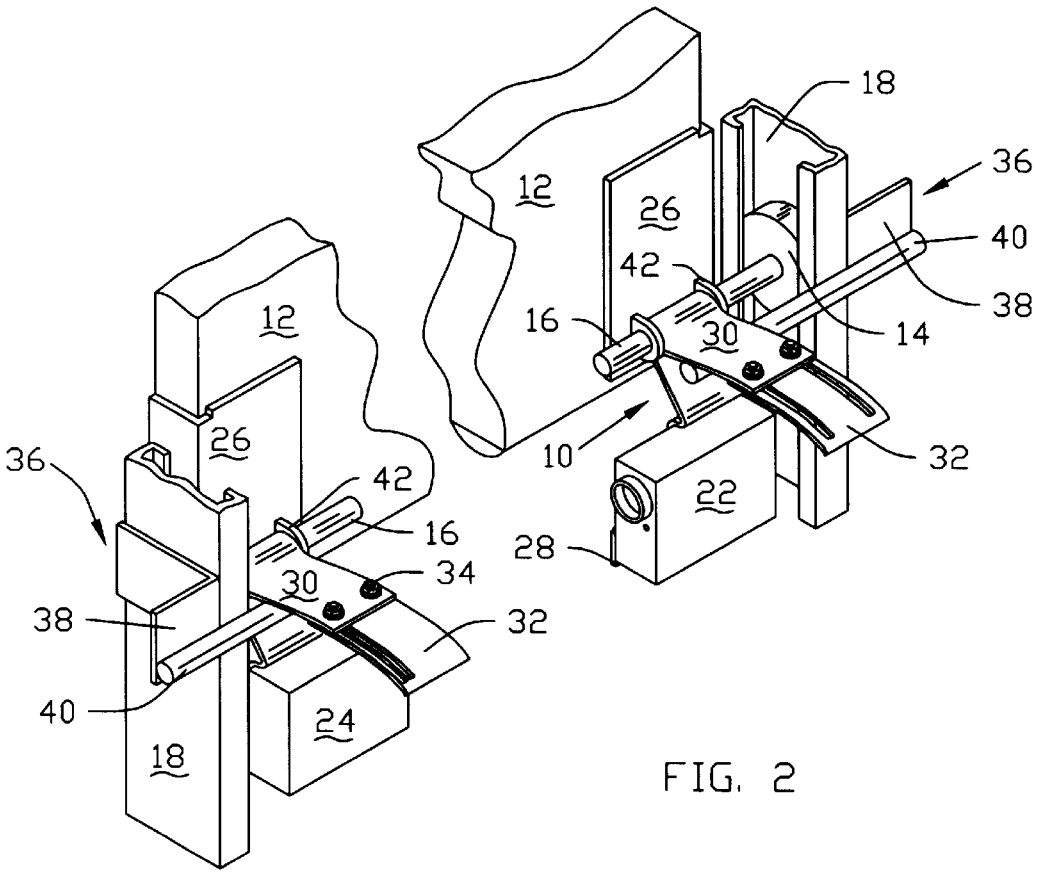
FIG. 2 is a detail perspective view of the safety sensors of an overhead door opening system.

With reference to the drawings, FIG. 1 shows an automated overhead door opening system with the sensor mounting brackets of the present invention. As shown in more detail in FIGS. 2 through 6, mounting brackets for overhead door safety sensors are designated generally as 10. As shown in FIG. 2, overhead door 12 is attached by rollers 14 and roller axles 16 to door tracks 18. The overhead door 12 is connected to door opener assembly 20 (shown in FIG. 1), which raises and lowers the overhead door. The door opener assembly 20 is electronically connected to safety sensors. The safety sensors include transmitter 22 and receiver 24. The transmitter 22 transmits a beam, typically an infrared light beam, to the receiver 24 when the door 12 is closing. If the beam transmitted from the transmitter 22 is not received by the receiver 24, the receiver sends a signal to the door opener assembly 20 which stops the closing of the door 12. The signal from the receiver 24 can also cause the door opener assembly 20 to reverse the direction of travel of the door 12 to open the door.

The components and the circuitry required to detect an object in the path of the door 12, and to reverse the travel path of the door, are well known in the art and are not described here. The transmitter 22 and the receiver 24 are preferably wireless devices, although the transmitter, receiver and opener assembly can be hardwire connected.

The safety sensors 22,24 are mounted on the mounting brackets 10. The mounting brackets 10 are attached to the bottommost roller axles 16. The bottommost roller axles 16 are attached at opposite lateral sides of the overhead door 12 to bottom fixtures 26.

Figure 3:
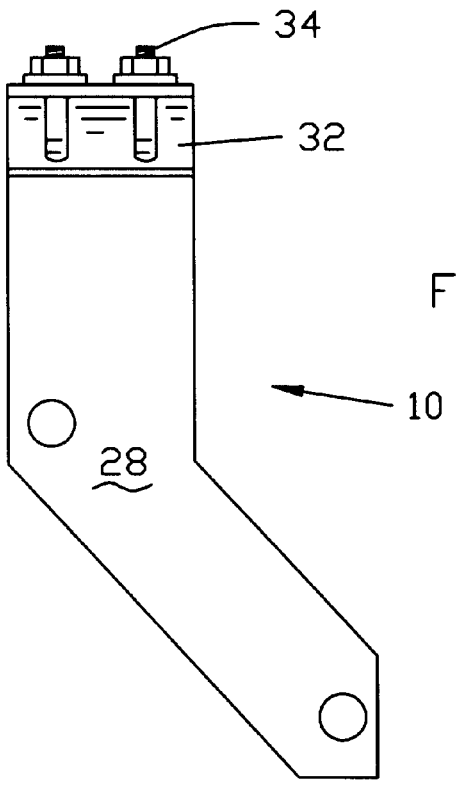
FIG. 3 is a front view of a safety sensor mounting bracket.
Figure 4:
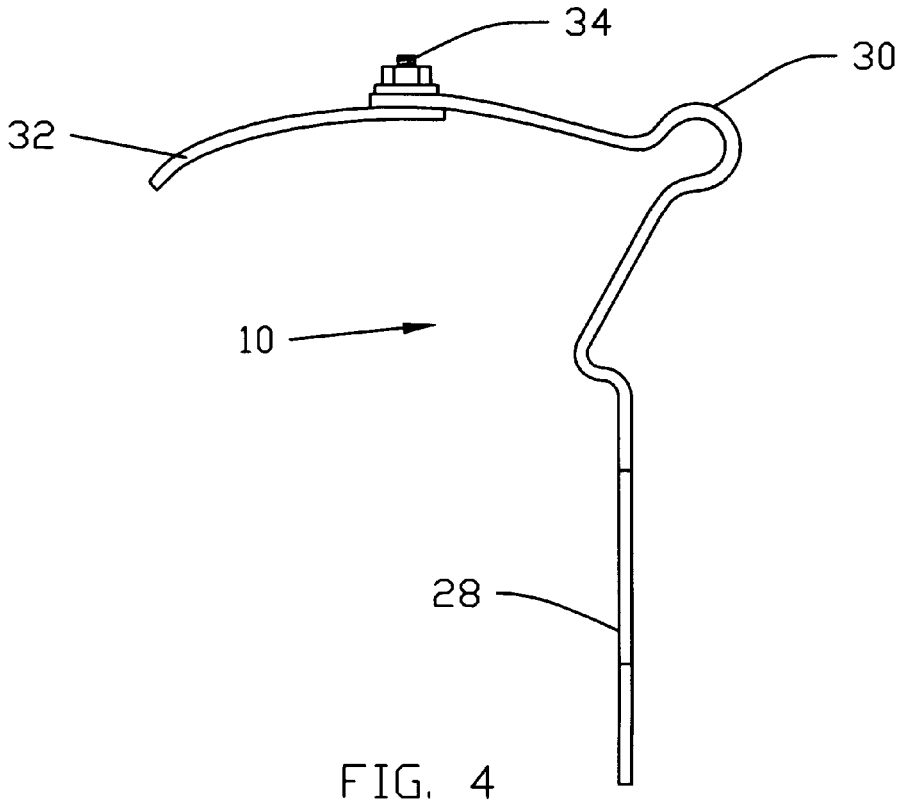
FIG. 4 is a side view of a safety sensor mounting bracket.

As shown in FIGS. 3 and 4, a mounting bracket 10 has safety sensor mounting surface 28, hinge mount 30, and rotation arm 32. The safety sensors 22, 24 attach by screws to the mounting surface 28. The hinge mounts 30 allow the mounting brackets 10 to be rotatively connected to the bottommost roller axles 16 of the overhead door 12. The length of a rotation arm 32 is adjustable. The rotation arm 32 is slotted and attaches to the mounting bracket 10 by means of screws 34.

Rotation arms 32 allow the mounting brackets 10 to rotate about the bottommost roller axles 16 when the rotation arms contact stators 36. Preferably, each stator 36 is mounted to a door track 18. The stator comprises mount 38, which attaches to the door track 18; and arm 40. The stators 36 are positioned at the same height with respect to the leading edge of the overhead door 12 so that when the door closes, each rotation arm 32 of a bracket 10 will simultaneously contact a stator arm 40 when the door approaches the door's closed position.

To attach a mounting bracket 10 and sensor 22 or 24 to an overhead door 12, the sensor is attached to the mounting surface 28 of the mounting bracket by screws. Then, the bottommost roller 14 on one side of the overhead door 12 is popped out of the door track 18 with the claw of a hammer (not shown). The bottom roller axle 16 is removed from the bottom fixture 26. Then the hinge mount 30 of the mounting bracket 10 is placed between axle supports 42 of the bottom fixture 26. The axle 16 is inserted through the axle supports 42 and the hinge mount 30. Then, the bottommost roller 14 is popped back into the door track 18. The same procedure is used to mount the second mounting bracket to the opposite lateral side of the overhead door 12.

Figure 5:
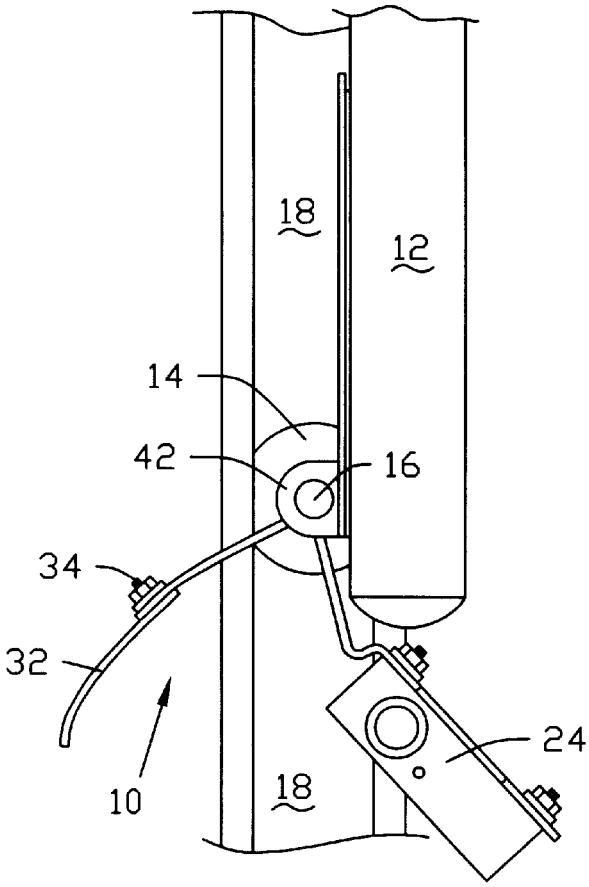
FIG. 5 is a side view of an overhead door opening system with the overhead door in an open position.
Figure 6:
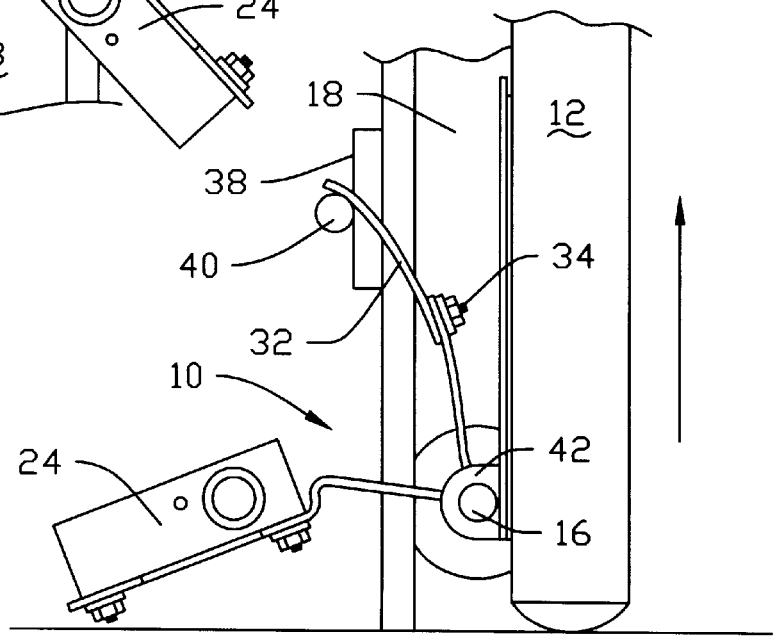
FIG. 6 is a side view of an overhead door opening system with the overhead door in a closed position.

When the overhead door 12 is open, the mounting bracket 10 will hang below the leading edge of the door as shown in FIG. 5. When the door 12 nears its closed position, the rotation arm 32 of each mounting bracket 10 contacts a stator arm 40 attached to the door track 18. As the door 12 continues to close, the mounting bracket rotates 10 about the bottommost roller axle 16 so that the sensors 22, 24 avoid contacting the ground. FIG. 6 shows an overhead door in a closed position.

The embodiments shown and described above are only exemplary. I do not claim to have invented all the parts, elements, or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. An overhead door obstruction safety sensor system, said system comprising:

an overhead door comprising a pair of bottom mounting brackets;

a pair of door tracks positioned on opposite sides of the overhead door;

a pair of rollers, each of said rollers comprising an axle and a wheel, wherein said axles are configured to couple the rollers to the bottom mounting brackets, and wherein said wheels are configured to be positioned in said door tracks;

a pair of safety sensor brackets rotatively attached to said axles, each of said safety sensor brackets having a sensor mounting surface and a rotation arm;

a transmitter connected to a sensor mounting surface of a safety sensor bracket;

a receiver connected to a sensor mounting surface of a safety sensor bracket, said receiver in working relation to said transmitter;

an overhead door opener connected to said overhead door and electronically connected to said transmitter and receiver; and a stator mounted adjacent to each door track, each of said stators contacts the rotation arm of a safety sensor bracket when the overhead door approaches a closed position so that each safety sensor bracket rotates about the axle the safety sensor bracket is connected to as the door continues to close.

2. The system of claim 1, wherein the transmitter and the receiver transmit infrared signals to the overhead door opener.

3. The system of claim 1, wherein the transmitter and the receiver are wired to the overhead door opener.

4. The system of claim 1, wherein the stators are configured to be attached to the door tracks.

5. The system of claim 1, wherein a length of the rotation arm is adjustable.

6. The system of claim 1, wherein at least one screw connects the transmitter to the sensor mounting surface.

7. The system of claim 1, wherein at least one screw connects the receiver to the sensor mounting surface.

* * * * *